US009004936B2

(12) United States Patent
Wang

(10) Patent No.: US 9,004,936 B2
(45) Date of Patent: Apr. 14, 2015

(54) EDGE CONNECTOR

(75) Inventor: Cheng-Chiuan Wang, Taipei (TW)

(73) Assignee: Golden Transmart International Co., Ltd., New Taipei (TW)

( * ) Notice: Subject to any disclaimer, the term of this patent is extended or adjusted under 35 U.S.C. 154(b) by 491 days.

(21) Appl. No.: 13/462,898

(22) Filed: May 3, 2012

(65) Prior Publication Data

US 2013/0171863 A1 Jul. 4, 2013

(30) Foreign Application Priority Data

Dec. 30, 2011 (TW) ..... 100149904 A

(51) Int. Cl.

| | |
|---|---|
| ***H01R 4/26*** | (2006.01) |
| ***H01R 43/16*** | (2006.01) |
| ***H01R 12/83*** | (2011.01) |
| *H01R 12/72* | (2011.01) |

(52) U.S. Cl.

CPC ..... *H01R 43/16* (2013.01); *Y10T 29/49218* (2015.01); *H01R 12/83* (2013.01); *H01R 12/721* (2013.01)

(58) Field of Classification Search

CPC ..... H01R 43/16; H01R 12/721
USPC ..... 439/326–329, 630
See application file for complete search history.

(56) References Cited

U.S. PATENT DOCUMENTS

| | | | | | |
|---|---|---|---|---|---|
| 3,289,146 | A * | 11/1966 | Tuchel | 439/630 |
| 3,977,757 | A * | 8/1976 | Yurtin | 439/852 |
| 4,087,151 | A * | 5/1978 | Robert et al. | 439/637 |
| 4,106,841 | A * | 8/1978 | Vladic | 439/637 |
| 4,209,220 | A * | 6/1980 | Szablowski | 439/862 |
| 4,288,139 | A * | 9/1981 | Cobaugh et al. | 439/267 |
| 4,514,030 | A * | 4/1985 | Triner et al. | 439/637 |
| 4,586,772 | A * | 5/1986 | Cobaugh et al. | 439/629 |
| 4,613,193 | A * | 9/1986 | Beers | 439/260 |
| 4,934,961 | A * | 6/1990 | Piorunneck et al. | 439/637 |
| 5,013,264 | A * | 5/1991 | Tondreault | 439/636 |
| 5,224,866 | A * | 7/1993 | Nakamura et al. | 439/81 |
| 6,152,790 | A * | 11/2000 | Morris | 439/862 |
| 6,183,267 | B1 * | 2/2001 | Marcus et al. | 439/91 |
| 6,276,951 | B1 * | 8/2001 | Chen et al. | 439/327 |
| 7,074,067 | B2 * | 7/2006 | Yang et al. | 439/326 |
| 8,021,178 | B1 * | 9/2011 | Lee et al. | 439/326 |

* cited by examiner

*Primary Examiner* — Briggitte R Hammond

(74) *Attorney, Agent, or Firm* — Rosenberg, Klein & Lee

(57) ABSTRACT

An edge connector is to accept a memory card therein, the memory card having two opposite side surfaces, each provided with a plurality of terminal contacts. The edge connector includes an insulated body formed with a reception chamber; a plurality of first and second terminals mounted on the insulated body, each having a fixing section extending into the reception chamber and a transmission section integrally formed with, bent relative to the fixing section and extending into the reception chamber in order to form a card slot therebetween. The transmission section of the first terminal has a scratching corner protruding into the card slot, wherein, forcibly insertion of the memory card into the card slot causes the scratching corner to scratch away of an oxidized layer formed on the terminal contacts of the memory card, thereby enhancing electrical connection between the memory card and the first and second terminals.

9 Claims, 17 Drawing Sheets

EDGE CONNECTOR

This application claims the benefits of the Taiwan Patent Application Serial NO. 100149904 filed on Dec. 30, 2011, the subject matter of which is incorporated herein by reference.

BACKGROUND OF THE INVENTION

1. Field of the Invention

The present invention relates to an electrical connector, more particularly to an electrical edge connector and a method for fabricating the electrical edge connector provided with a scratching corner.

2. Description of the Prior Art

Due to rapid advance in the electronic technology, some electronic devices become indispensable handy electronic devices for a majority of the consumers. These handy electronic devices include for instance an electrical edge connector for transmission of signals between two electronic devices and for establishing electrical communication between a main electronic device and a peripheral device.

Referring to FIGS. 1 and 2, wherein FIG. 1 shows a perspective view of a conventional edge connector, while FIG. 2 shows perspective view of upper and lower rows of terminals PA2, PA3 employed therein. As illustrated, the edge connector PA100 includes an insulated body PA1 formed with a reception chamber PA11, into which, a memory card (not shown) is to be inserted, a pair of clamping members PA4, PA5 extending from two opposite ends thereof, and upper and lower rows of terminals PA2, PA3 inserted into the reception chamber PA11 for establishing electrical connection between the terminals PA2, PA3 and the memory card.

Each upper terminal PA2 has a fixing section PA21 inserted into the reception chamber PA11 and a transmission section PA22 integrally formed with, bent relative to the fixing section PA21 and inserted into the reception chamber PA11. The transmission section PA22 is provided with a contact end PA221.

Each lower terminal PA3 has a fixing section PA31 inserted into the reception chamber PA11 and a transmission section PA32 integrally formed with, bent relative to the fixing section PA31 and inserted into the reception chamber PA11. The transmission section PA32 is provided with a contact end PA321.

During insertion of the memory card (not shown) into the reception chamber PA11, the contact ends PA221, PA321 of the transmission sections of the upper and lower terminals PA2, PA3 will get in touch with the metal contacts formed on two opposite sides of the memory card, thereby removing away the oxidized layer formed on the metal contacts.

Note that since the oxidized layer on the memory card are removed due to presence of the contact ends PA221, PA321 of the transmission sections of the upper and lower terminals PA2, PA3 within the reception chamber PA11, remaining of undesired waste between the terminals PA2, PA3 and the memory card may affect an electrical communication between the memory card and the upper and lower terminals.

SUMMARY OF THE INVENTION

Therefore, the main object of the present invention is to provide an electrical edge connector having the ability to scratch the oxidized layer effectively away from the memory card during insertion of the latter into the edge connector of the present invention.

As explained above, in the prior art technique in order to established effective electrical connection between a memory card and the conventional edge connector, the contact ends of the terminals are generally used to scratch away the oxidized layer on the memory during the latter insertion into the conventional edge connector. Hence the metal contacts of the memory card are in direct contact with the contact ends of the terminals of the conventional edge connector. Though the scratching off the oxidized layer on the memory card is relatively effective, the waste resulted thereby is often left between the metal contacts of the memory card and the terminals of the conventional edge connector, thereby adversely affect the electrical connection between the memory card and the terminals.

In order to solve the abovementioned problem, the edge connector of the present invention is proposed, wherein a plurality of first and second terminals are mounted within an insulated body in such a manner that each first terminal has a first transmission section provided with a scratching corner. Each second terminal has a second transmission section cooperating with the first transmission section of the first terminal to define a card slot therebetween such that forcibly insertion of a memory card into the card slot causes the scratching corners to scratch away of an oxidized layer, which is formed on the memory card, thereby enabling the scratching corners of the first terminals to contact directly with the terminal contacts of the memory card and hence enhancing electrical connection between the memory card and the first and second terminals.

The second object of the present invention is to provide an edge connector and a fabricating method for fabricating the edge connector.

The edge connector of the present invention is adapted to accept a memory card therein, the memory card having two opposite side surface, each provided with a plurality of terminal contacts. The edge connector accordingly includes an insulated body formed with a reception chamber; a plurality of first terminals mounted on the insulated body, each having a fixing section extending into the reception chamber and a transmission section integrally formed with, bent relative to the fixing section and extending into the reception chamber, the transmission section being provided with a scratching corner; a plurality of second terminals mounted on the insulated body, each having a fixing section extending into the reception chamber and a transmission section integrally formed with, bent relative to the fixing section and extending into the reception chamber and cooperating with the transmission section of the first terminal to define a card slot therebetween, the scratching corner of the first terminal projecting into the card slot. After mounting of the first and second terminals on the insulated body, forcibly insertion of the memory card into the card slot causes the scratching corner to scratch away of an oxidized layer, which is formed on the terminal contacts of the memory card, thereby enhancing electrical connection between the memory card and the first and second terminals.

The edge connector of the present invention further includes left and right support arms extending outwardly and transversely from two opposite ends of the insulated body. Each of the left and right support arms has an arm body provided a clamping structure for clamping the memory card therebetween. Preferably, the clamping structure of a respective one of the left and right support arms includes an L-shaped block and an inclined block located above the L-shaped block.

Each of the left and right support arms further has an arm body provided the clamping structure and a floating positioning structure located below and connected movably to the clamping structure.

In one embodiment of the present invention, the fixing section of one of the first and second terminals has a the structure engaging with the insulated body in such a manner to prevent untimely removal of the first and second terminals from the insulated body.

The fabricating method of the present invention is used for fabrication the above-mentioned edge connector includes steps of:

(a) providing a first terminal sheet having a contact section;

(b) providing a punching apparatus including a first die located above the first terminal sheet and having a first punch element in alignment with the contact edge of the first terminal sheet and a second die disposed below the first terminal sheet and having a second punch element in alignment with the contact section of the first terminal sheet, wherein the first and second punch elements are staggered relative to each other by a predetermined distance that extends along a feed-in direction of the first terminal sheet and that is smaller than a width of the contact section;

(c) after feeding the first terminal sheet along the feed-in direction and continuous punching of the first and second punch elements relative to the contact section results in formation of a scratching corner in the first terminal sheet;

(d) providing a second terminal sheet and an insulated body;

(e) bending and cutting off opposite ends of the first and second terminal sheets in order to form a plurality of first and second terminals having structures as defined in the above paragraphs; and (f) mounting the first and second terminals onto the insulated body in order to form the edge connector as defined in the above paragraphs.

Preferably, each of the first and second punch elements has a blunt corner for contacting the contact section in the first terminal sheet.

The step (d) further includes a substep of providing left and right support arms onto the insulated body such that the left and right support arms extend outwardly and transversely from two opposite ends of the insulated body.

When compared to the prior art edge connector, since the scratching corners of the first terminals are used to scratch away the oxidized layer on the memory card, the oxidized layer is effectively scratched off, hence providing fine electrical connection between the memory card and the terminals of the edge connector of the present invention. In addition, the fabrication method of the present invention provides formation of a scratching corner on the first terminal due to novel and continuous punching technique of the punching apparatus employed therein.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

The edge connector of the present invention proposes terminal structures widely used in different types of electrical connectors for transmission of signals between two electronic devices. Since assembly of the terminals within the electrical connector differs from one another, the structure of an edge connector is used in the following paragraphs for better understand of the present invention, however the scope of the present invention should not be limited to those given in the examples.

Figure 1:
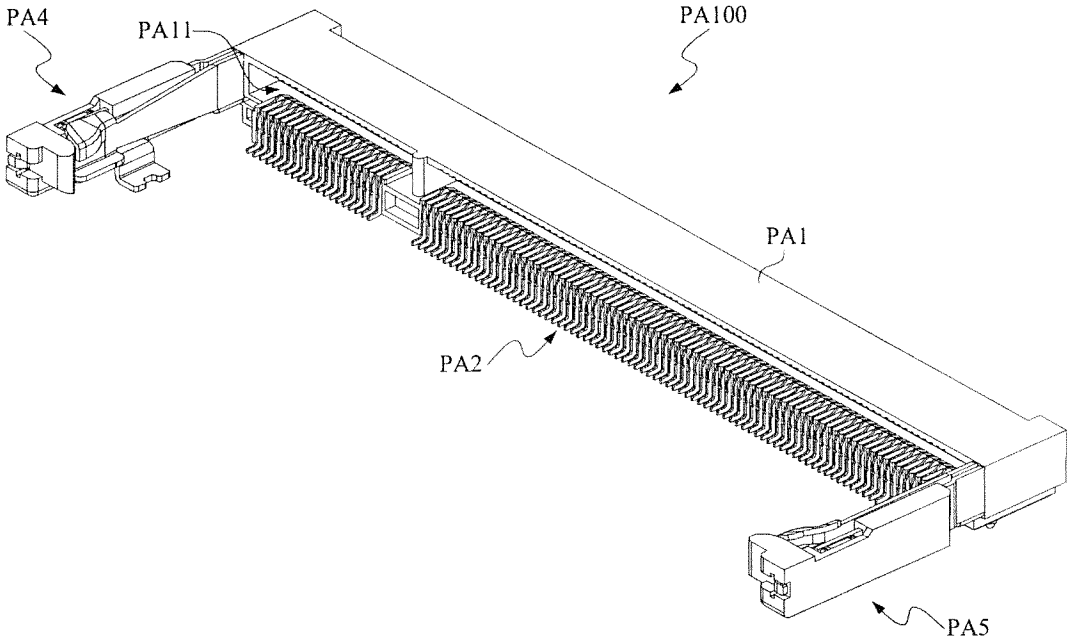
FIG.1(Prior Art)
FIG. 1 shows a perspective view of a prior art edge connector.
Figure 2:
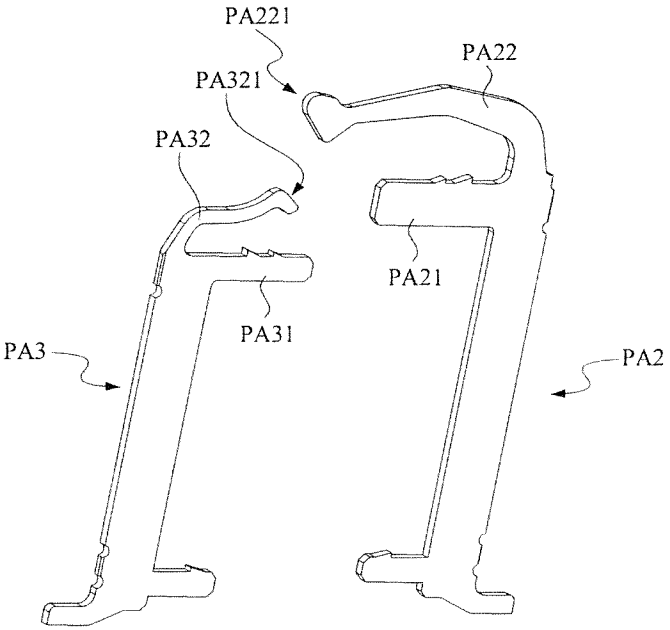
FIG.2(Prior Art)
FIG. 2 is a perspective view of upper and lower terminals employed in the prior art edge connector shown in FIG. 1.
Figure 3:
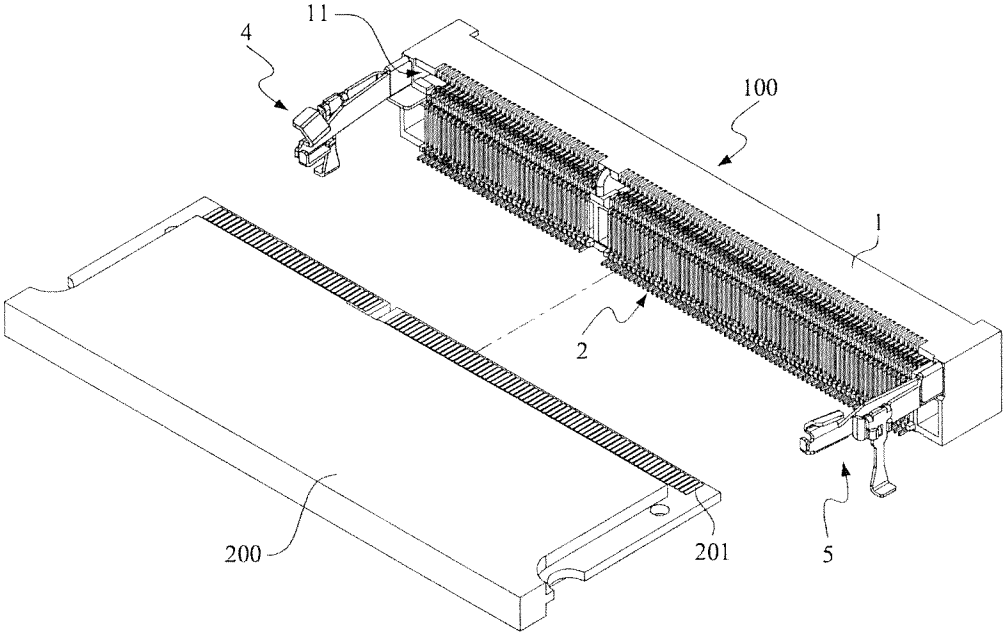
FIG. 3 shows a perspective view of an edge connector of the present invention into which a memory card is to be inserted for establishing an electrical communication therebetween.
Figure 4:
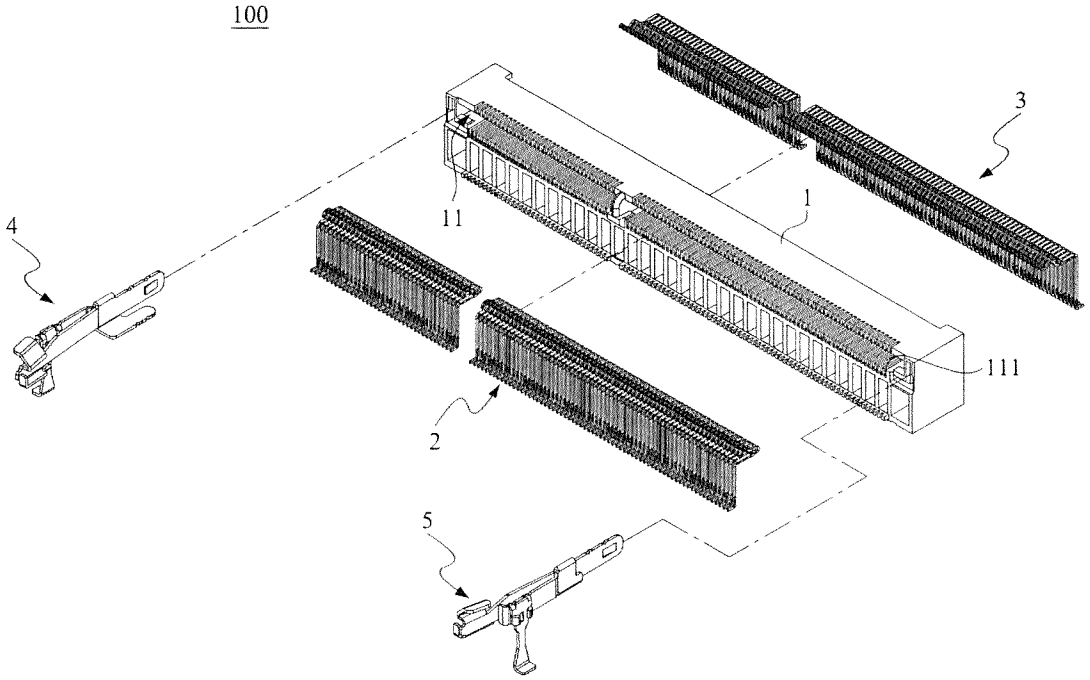
FIG. 4 is an exploded view of the edge connector of the present invention.

Referring to FIGS. 3 and 4, wherein FIG. 3 shows a perspective view of an edge connector of the present invention into which a memory card 200 is to be inserted for establishing an electrical communication therebetween, while FIG. 4 is an exploded view of the edge connector of the present invention. As illustrated, the edge connector 100 of the present invention includes an insulated body 1, a plurality of first terminals 2, a plurality of second terminals 3 and left and right support arms 4, 5.

The insulated body 1 is formed with a reception chamber 11. The reception chamber 11 is further formed with first and second terminal slots 111, 112 (see FIG. 6) in spatial communication with each other.

Figure 5:
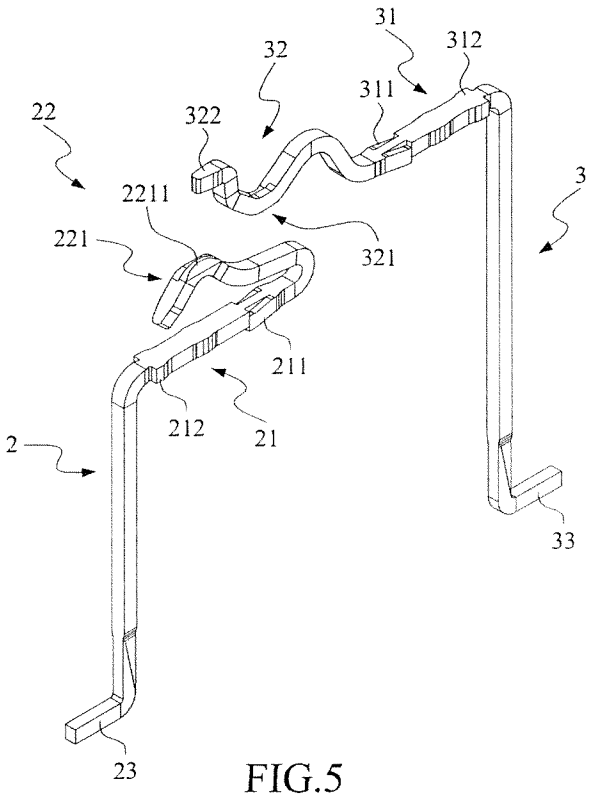
FIG. 5 is a perspective view of first and second terminals employed in the edge connector of the present invention shown in FIG. 1.
Figure 6:
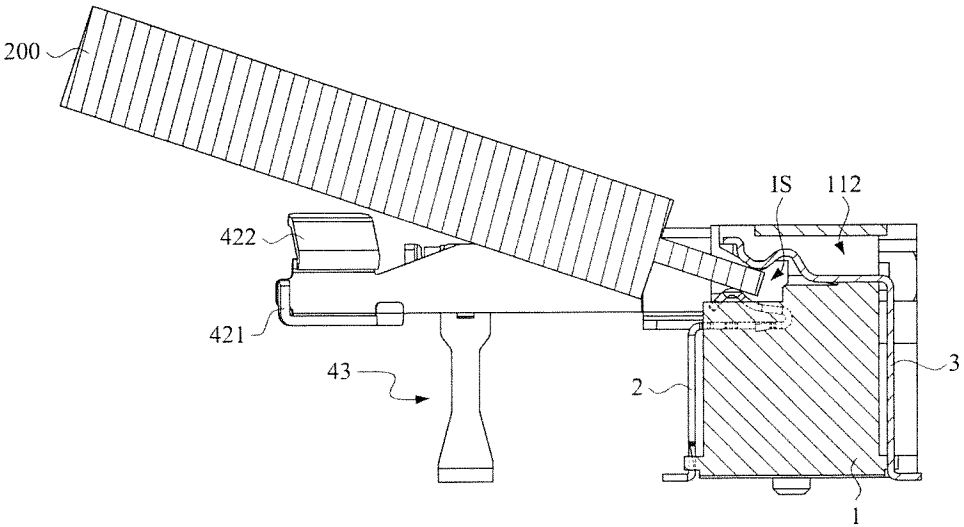
FIGS. 6 and 7 shows two different positions of a memory card during and after insertion the memory card into the edge connector of the present invention.
Figure 7:
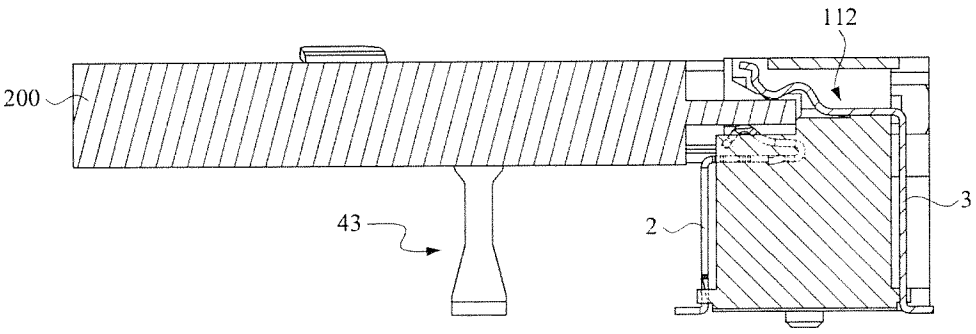

Referring to FIGS. 3 to 7, wherein FIG. 5 is a perspective view of the first and second terminals 2, 3 employed in the edge connector 100 of the present invention shown in FIG. 3, while FIGS. 6 and 7 shows two different positions of the memory card 200 during and after insertion the memory card 200 within the edge connector 100 of the present invention. The first terminals 2 are mounted on the insulated body 1. Each first terminal 2 has a fixing section 21 provided with a stop structure 211 engaging securely the first terminal slot 111 at an interior thereof and a limiting structure 212 engaging the first terminal slot 111 at an exterior thereof, thereby preventing untimely removal of the first terminals 2 relative to the insulated body 1. Each first terminal 2 further has a transmission section 22 integrally formed with, bent relative to the fixing section 21 and extending into the first terminal slot 111, and a soldering section 23 bent relative to the fixing section 21 in a different direction relative to the transmission section 22. The transmission section 22 is provided with a scratching corner 2211.

The second terminals 3 are mounted on the insulated body 1. Each second terminal 3 has a fixing section 31 provided with a stop structure 311 engaging securely the second terminal slot 112 at an interior thereof and a limiting structure 312 engaging the second terminal slot 112 at an exterior thereof, thereby preventing untimely removal of the second terminals 3 relative to the insulated body 1. Each second terminal 3 further has a transmission section 32 integrally formed with, bent relative to the fixing section 31 and extending into the second terminal slot 112 and cooperating with the transmission section 22 of the first terminal 2 to define a card slot (IS) therebetween and a soldering section 33 bent relative to the fixing section 31 in a different direction relative to the transmission section 32 of the second terminal 3. The transmission section 32 of each second terminal 3 further has a curved part 321 and a distal part 322 integrally formed with the curved part 321 and extending into the second terminal slot 112. After mounting of the first and second terminals 2, 3 on the insulated body 1, the scratching corners 2211 of the first terminals 2 extend into the card slot (IS). Note that the memory card 200 has two opposite side surfaces; each is provided with a plurality of terminal contacts 201. Under this condition, forcibly insertion of the memory card 200 into the card slot (IS) causes the scratching corners 2211 to scratch away an oxidized layer, which is formed on the terminal contacts 201 of the memory card 200, thereby enhancing electrical connection between the memory card 200 and the first and second terminals 2, 3.

Figure 8:
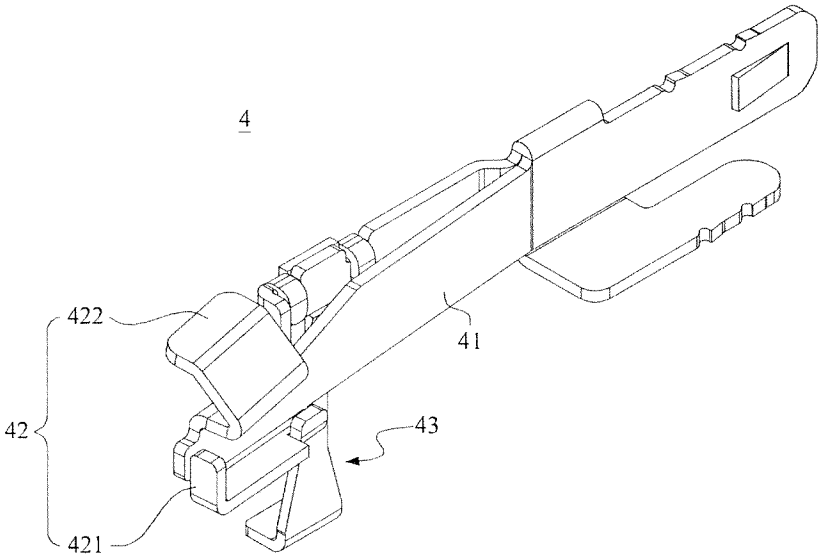
FIG. 8 is a perspective view of a support arm employed in the edge connector of the present invention shown in FIG. 3.
Figure 9:
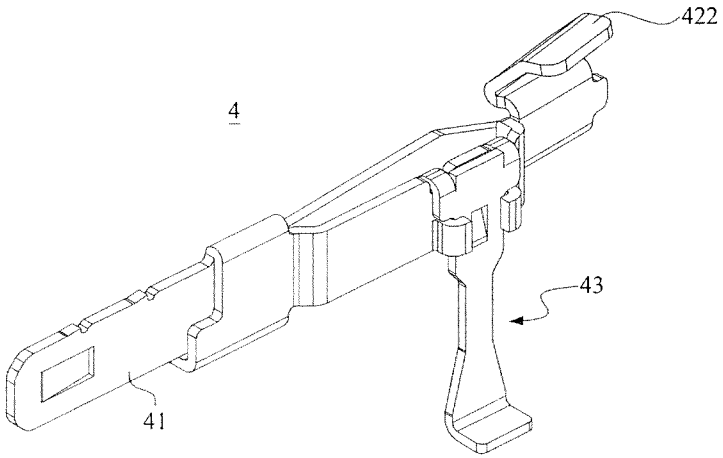
FIG. 9 is a perspective view of the support arm employed in the edge connector of the present invention from another angle.

Referring to FIGS. 8 and 9, wherein FIG. 8 is a perspective view of the left or right support arm 4, 5 employed in the edge connector 100 of the present invention shown in FIG. 3, while FIG. 9 is a perspective view of the left or right support arm 4, 5 employed in the edge connector 100 of the present invention from another angle. As illustrated, the left and right support arms 4, 5 extend outwardly and transversely from two opposite ends of the insulated body 1. The left support arm 4 has an arm body 41 that is integrally formed with the insulated body 1 and that is provided a clamping structure 42 for clamping the memory card 200 therebetween. The clamping structure 42 of the left support arm 4 includes an L-shaped block 421 projecting axially from the arm body 41 and an inclined block 422 located above and cooperated with the L-shaped block 421 to prevent downward movement of the memory card 200 and simultaneously assists in alignment of the memory card 200 with respect to the card slot (IS) during insertion of the former relative to the latter, which, in turn, enables firm clamping of the memory card 200 between the clamping structures 42. The left support arm 4 further has a floating positioning structure 43 located below and connected movably to the clamping structure 42 such that the floating positioning structure 43 assists adjustment of the edge connector 100 to a correct position on a printed circuit board (not shown) when the soldering sections 23, 33 of the first and second terminals 2, 3 are soldered onto the printed circuit board.

Since the structure of the right support arm 5 is the same as the left support arm 4, a detailed description of the same is omitted herein for the sake of brevity.

Figure 10:
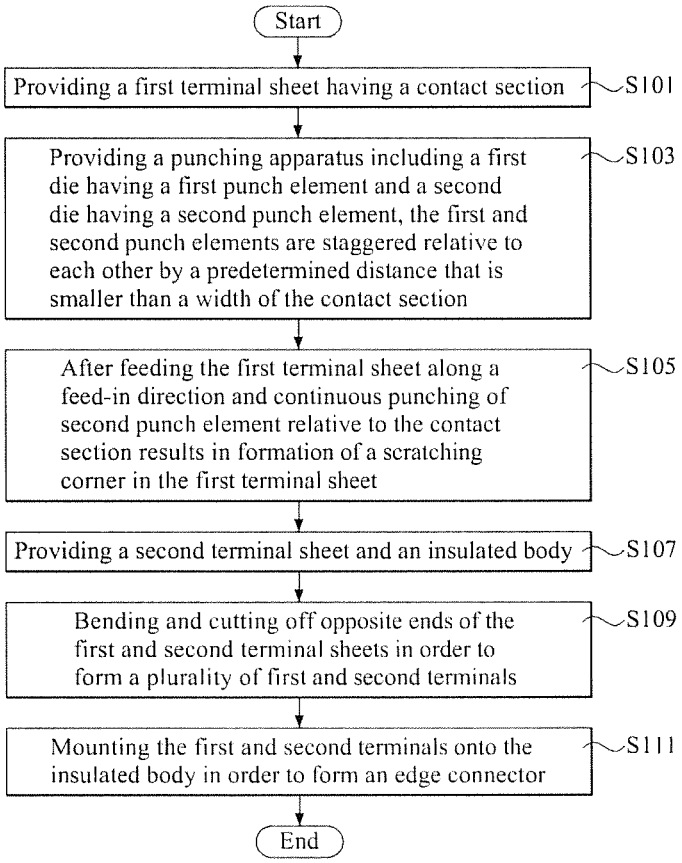
FIG. 10 is a block diagram illustrating the steps included in a method for fabricating the edge connector of the present invention.
Figure 11:
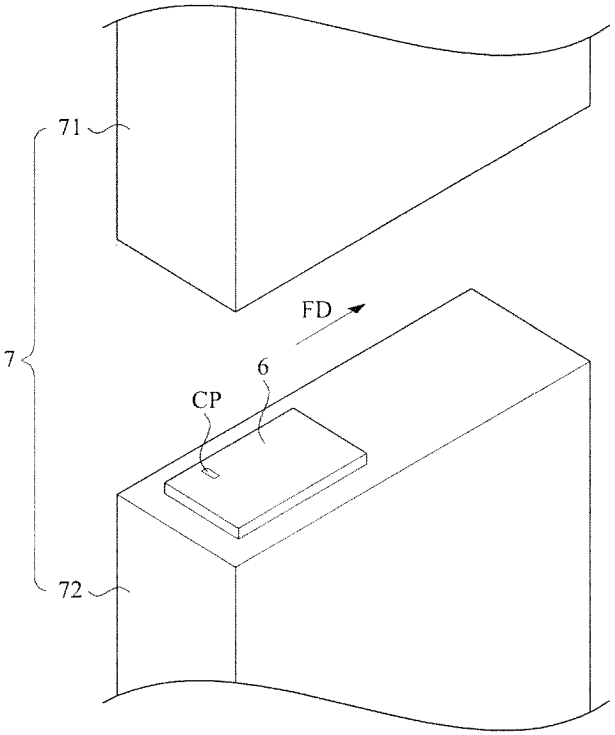
FIG. 11 illustrates how a punching apparatus punch a first terminal sheet in the method for fabricating the edge connector of the present invention.
Figure 12:
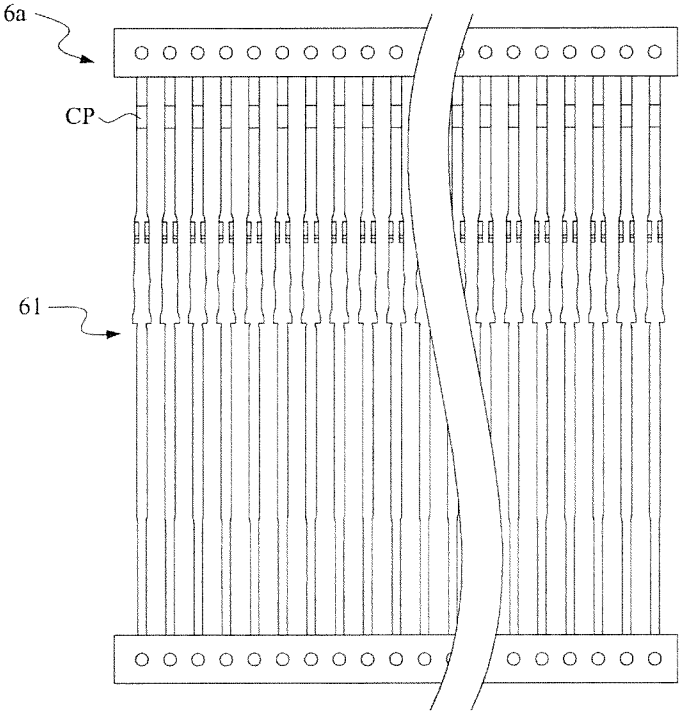
FIG. 12 shows a semi-finished of the first terminal sheet in the method for fabricating the edge connector of the present invention.
Figure 13:
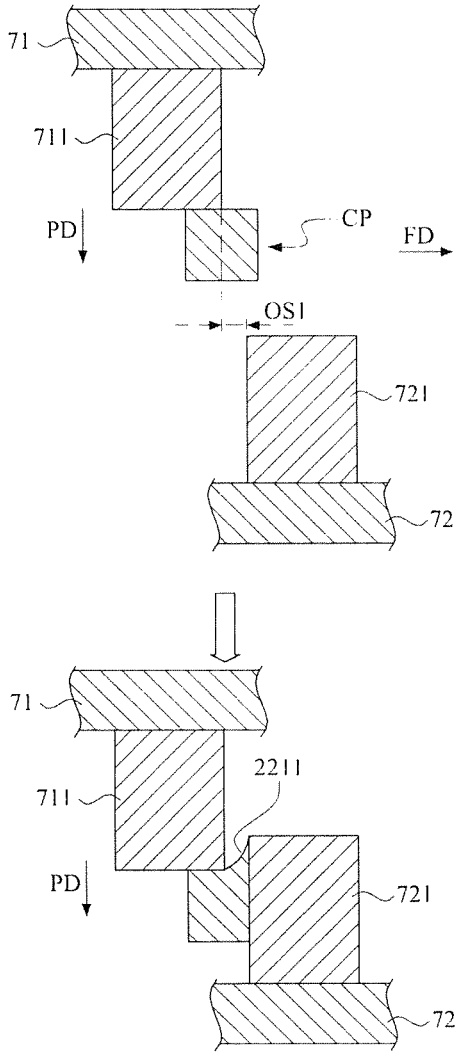
FIG. 13 shows a semi-finished of a first terminal produced by first and second dies in the method for fabricating the edge connector of the present invention.
Figure 14:
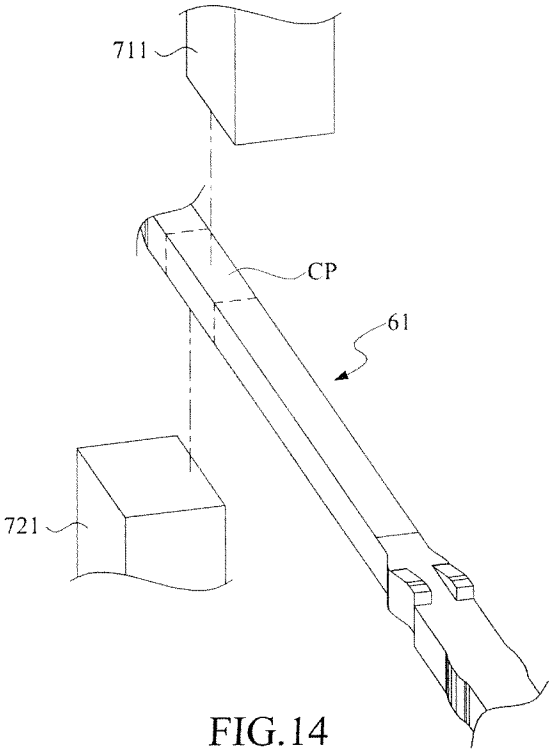
FIG. 14 shows the semi-finished of the first terminal together with first and second punch elements of the first and second dies in the method for fabricating the edge connector of the present invention.
Figure 15:
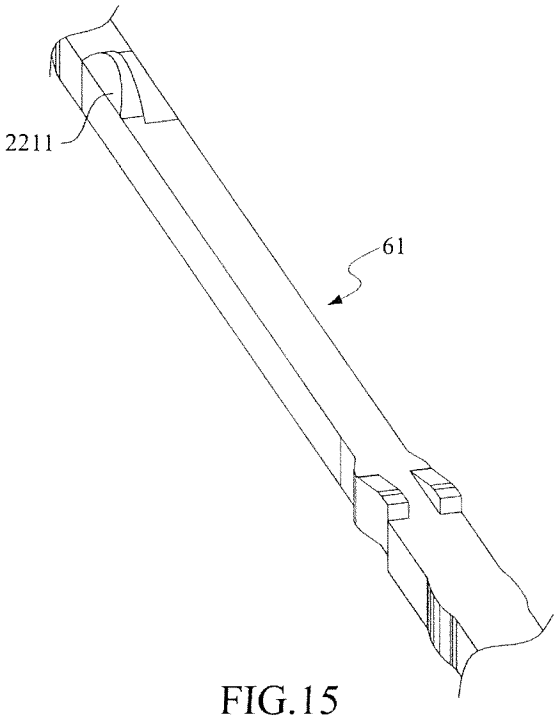
FIG. 15 illustrates how a scratching corner is formed on the semi-finished of the first terminal in the method for fabricating the edge connector of the present invention.

Referring to FIGS. 10 to 15, wherein FIG. 10 is a block diagram illustrating the steps included in a method for fabricating the edge connector 100 of the present invention; FIG. 11 illustrates how a punching apparatus punch a first terminal sheet in the method for fabricating the edge connector of the present invention; FIG. 12 shows a semi-finished of the first terminal sheet in the method for fabricating the edge connector of the present invention; FIG. 13 shows a semi-finished of a first terminal produced by first and second dies in the method for fabricating the edge connector of the present invention; FIG. 14 shows the semi-finished of the first terminal together with first and second punch elements of the first and second dies in the method for fabricating the edge connector of the present invention; and FIG. 15 illustrates how a scratching corner is formed on the semi-finished of the first terminal in the method for fabricating the edge connector of the present invention. As illustrated, in accordance with the step S101: a first terminal sheet 6 is provided, which as a contact section CP. Note that the contact section CP is relatively small in length, only a fragmentary section of the first terminal sheet is shown in FIG. 11.

In accordance with the step S103: a punching apparatus 7 is provided to include a first die 71 located above the first terminal sheet 6 and having a first punch element 711 in alignment with the contact section CP of the first terminal sheet 6 and a second die 72 disposed below the first terminal sheet 6 and having a second punch element 721 in alignment with the contact section CP of the first terminal sheet 6, wherein the first and second punch elements 71, 72 are staggered relative to each other by a predetermined distance OS1 that extends along a feed-in direction FD of the first terminal sheet 6 and that is smaller than a width of the contact section CP.

In accordance with the step S105: after feeding the first terminal sheet 6 along the feed-in direction FD and continuous punching between the first and second punch elements 711, 721 along the vertical direction relative to the contact section CP results in formation of a scratching corner 2211 in the first terminal sheet 6.

As explained above, due to continued punching action, the first terminal sheet 6 is cut into a semi-finished first terminal sheet **6*a* such that the semi-finished first terminal sheet 6*a* includes a plurality of juxtaposed semi-finished first terminals 61. Each semi-finished first terminal 61 has the contact section CP, upon which the punch elements continuously punch in order to form the scratching corner 2211**.

Referring to FIG. 13, the first and second punch elements 711, 721 are staggered relative to each other by a predetermined distance OS1 that extends along a feed-in direction FD of the first terminal sheet 6 and that is smaller than a width of the contact section CP. Under this condition, during the punching operation of the first die 71 along the punching direction PD, the contact section CP thereof is punched in a wider area due to stagger position of the first and second punch elements 711, 712, thereby forming the scratching corner 2211 due to the fine ductility of the first terminal sheet 6.

In accordance with the step S107; a second terminal sheet and an insulated body 1 are provided in such a manner that the insulated body 1 has left and right support arms 4, 5 extending outwardly and transversely from two opposite ends thereof. In accordance with the step S109; the opposite ends of the first and second terminal sheets are bent and cut off in order to form a plurality of first and second terminals 2, 3 having structures as defined in the above paragraphs. Finally, according to the step S111, the first and second terminals 2, 3 are mounted on the insulated body 1 while the left and right support arms 4, 5 are mounted to the opposite ends of the insulated body 1, thereby achieving the edge connector of the present invention. Regarding to the steps S107, S109 and S111 are common in the metal punching operation; a detailed disclosure thereof is omitted herein for the sake of brevity.

Figure 16:
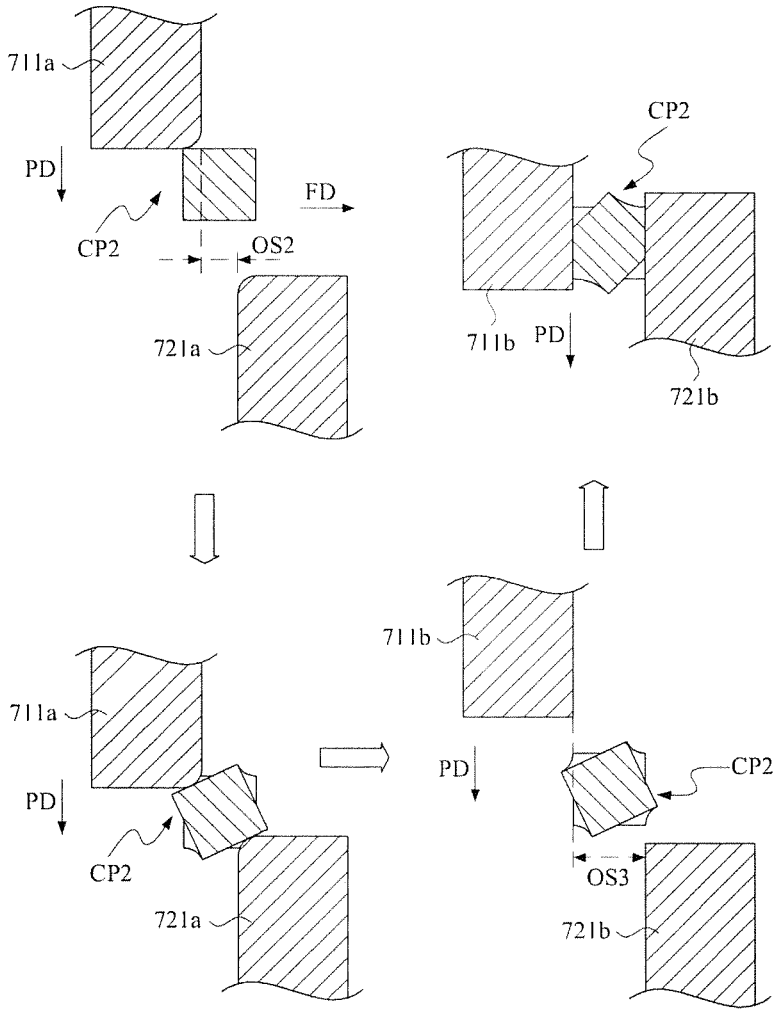
FIG. 16 illustrates cross sectional view of the contact section, the first and second punch elements during the continuous punching between the first and second dies relative to the semi-finished of the first terminal sheet in order to form the scratching corner shown in FIG. 15.

FIG. 16 illustrates cross sectional views of the contact section, the first and second punch elements during continuous punching between the first and second dies relative to the semi-finished of the first terminal sheet in order to form the scratching corner shown in FIG. 15. As shown, the first and second punch elements 711*a*, 721*a* are staggered by a predetermined distance OS2, which is smaller than a width of the contact section CP2 while the predetermined distance OS3 between the third and fourth punch elements 711*b*, 721*b* is equivalent to the width of the contact section CP2. Under this condition, relative punching operation between the first and second punch elements 711*a*, 721*a* results in twisting of the contact section CP2, since the contacting area of the first and second punch elements 711*a*, 721*a* is the same such that two opposite corners of the contact section CP2 is punched uniformly and hence twisted. In addition, each of the first and second punch elements 711*a*, 721*a* has a blunt corner for contacting the contact section CP2 during the punching operation, such that there is no shearing off the contact section CP2.

Afterwards, the contact section CP2 is punched continuously by the third and fourth punching elements 711*b*, 721*b*. Since the staggered predetermined distance OS3 between the third and fourth punching elements 711*b*, 721*b* is the same as the width of the contact section CP2, two opposite corners of the contact section CP2 are uniformly sheared off with a greater force during relative punching operation between the third and fourth punching elements 711*b*, 721*b*, hence simultaneously causing twisting of the sheared corners.

Figure 17:
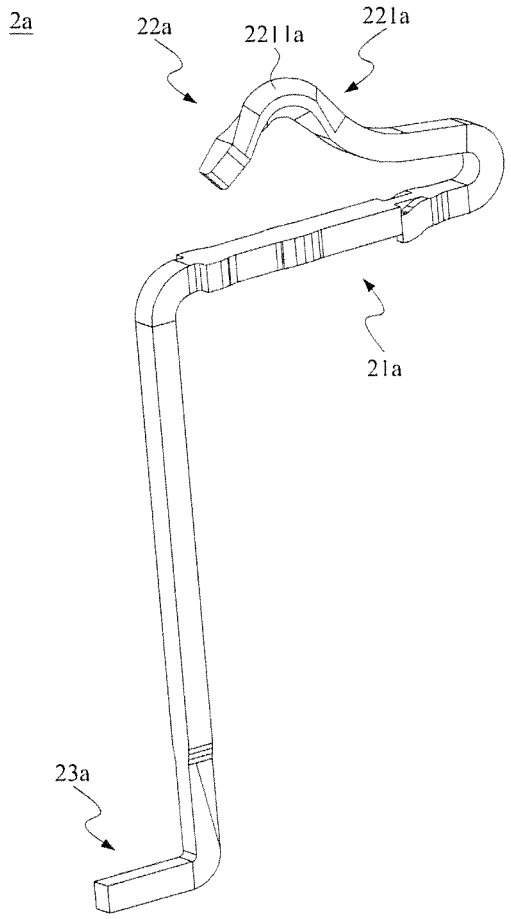
FIG. 17 is a perspective view of a modified first terminal in the method for fabricating the edge connector of the present invention.

FIG. 17 is a perspective view of a modified first terminal in the method for fabricating the edge connector of the present invention. The first terminal 2*a* has a first fixing section 21*a*, a first transmission section 22*a* integrally formed with, bent relative to the first fixing section 21*a* and a first soldering section 23*a*, wherein the first transmission section 22*a* further has a curved part 221*a* provided with the scratching corner 2211*a*, which is formed by partial punching operation between the first and second punching elements 711*a*, 721*a* and between the third and fourth punching elements 711*b*, 721*b* relative to the contact section CP2.

In the event, the contact section CP2 is made from a relatively hard metal, the punching operation of the same can be conducted in separated steps in order to prevent breakup of the terminals into pieces. In addition, each of the first and second punching elements 711*a*, 721*a* has a blunt corner for colliding against the contact section CP2, the latter is twisted effectively with causing severe shearing off of the contact section CP2.

The advantages provided by the edge connector 100 of the present invention are as follows:

(i) Due to presence the scratching corner on the transmission section of a respective first terminal and since the scratching corner projects into the card slot, forcibly insertion of the memory card into the card slot causes the scratching corner to scratch away of the oxidized layer formed on the terminal contacts of the memory card, thereby enhancing electrical connection between the memory card and the first terminals. Since the second terminal also has the scratching corner with a relatively sharpness, the scratch away of the oxidized layer from the memory card is more enhanced when compared to the prior art technique.

(ii) The left and right support arms of the edge connector of the present invention are provided with clamping structures having L-shaped blocks and an inclined block for clamping the memory card therebetween, the card is prevented from undesired displacement relative to the insulated body, thereby allowing smooth signal transmission between the memory card and the edge connector of the present invention.

(iii) The support arms of the edge connector further have floating positioning structures located below and connected movably to the clamping structure such that the floating positioning structure assists adjustment of the edge connector to the correct position on a printed circuit board (not shown) so that there is no tolerance error when the terminals are soldered onto the printed circuit board.

(iv) After mounting of the first and second terminals on the insulated body, the stop structures thereof engage securely the terminal slot at an interior thereof and the limiting structures thereof engage the terminal slot at an exterior thereof, thereby preventing untimely removal of the first terminals 2 relative to the insulated body. In other words, the first and second terminals are mounted on the insulated body in a more efficient way.

(v) In fabricating the edge connector of the present invention, the scratching corners on the terminals are formed punching operation between relative staggered punching elements. Note that the staggered predetermined distance between the punching elements can be adjusted in accordance with the requirement of terminal sheets while the punching operation of the terminal sheet can be conducted in separated steps to prevent breakup of the terminals during the punching operation.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An edge connector adapted to accept a memory card therein, the memory card having two opposite side surface, each provided with a plurality of terminal contacts, the electrical connector comprising:

an insulated body formed with a reception chamber;

a plurality of first terminals mounted on said insulated body, each having a fixing section extending into the reception chamber and a transmission section integrally formed with, bent relative to the fixing section and extending into said reception chamber, said transmission section being provided with a scratching corner;

a plurality of second terminals mounted on said insulated body, each having a fixing section extending into said reception chamber and a transmission section integrally formed with, bent relative to the fixing section and extending into said reception chamber and cooperating with said transmission section of said first terminal to define a card slot therebetween, said scratching corner of said first terminal projecting into said card slot; and left and right support arms extending outwardly and transversely from two opposite ends of said insulated body, each of said left and right support arms having an arm body and a clamping structure for clamping the memory card therebetween and a floating positioning structure located below said clamping structure and connected movably to said clamping structure;

wherein, forcibly insertion of the memory card into said card slot causes said scratching corner to scratch away of an oxidized layer, which is formed on the terminal contacts of the memory card, thereby enhancing electrical connection between the memory card and said first and second terminals.

2. The edge connector according to claim 1, wherein said transmission section of said first terminal has a curved part protruding into said card slot with said scratching corner being provided on said curved part.

3. The edge connector according to claim 1, further comprising left and right support arms extending outwardly and transversely from two opposite ends of said insulated body, each of said left and right support arms having an arm body provided a clamping structure for clamping the memory card therebetween.

4. The edge connector according to claim 3, wherein said clamping structure of a respective one of said left and right support arms includes an L-shaped block and an inclined block located above said an L-shaped block.

5. The edge connector according to claim 1, wherein said fixing section of one of said first and second terminals has a stop structure engaging with said insulated body in such a manner to prevent untimely removal of said first and second terminals from said insulated body.

6. A method for fabricating an edge connector, comprising steps of:

(a) providing a first terminal sheet having a contact section;

(b) providing a punching apparatus including a first die located above said first terminal sheet and having a first punch element in alignment with said contact section of said first terminal sheet and a second die disposed below said first terminal sheet and having a second punch element in alignment with said contact section of said first terminal sheet, wherein said first and second punch elements are staggered relative to each other by a predetermined distance that extends along a feed-in direction of said first terminal sheet and that is smaller than a width of said contact section;

(c) after feeding said first terminal sheet along said feed-in direction and continuous punching of said first and second punch elements relative to said contact section results in formation of a scratching corner in said first terminal sheet;

(d) providing a second terminal sheet and an insulated body;

(e) bending and cutting off opposite ends of said first and second terminal sheets in order to form a plurality of first and second terminals; and (f) mounting said first and second terminals onto said insulated body in order to form the edge connector.

7. The method according to claim 6, wherein each of said first and second punch elements has a blunt corner for contacting said contact section in said first terminal sheet.

8. The method according to claim 6, wherein the step (d) further includes a substep of providing left and right support arms onto said insulated body.

9. The method according to claim 8, wherein the step (f) further includes a substep of providing said left and right support arms to extend outwardly and transversely from two opposite ends of said insulated body.

* * * * *